US006450357B1

(12) United States Patent
Krautkramer et al.

(10) Patent No.: US 6,450,357 B1
(45) Date of Patent: Sep. 17, 2002

(54) PLASTIC LID WITH PLASTIC SEAL

(75) Inventors: Gunter Jakob Krautkramer; Lothar Brauer, both of Budenheim (DE)

(73) Assignee: Bericap GmbH & Company KG, Budenheim (DE)

( * ) Notice: Subject to any disclaimer, the term of this patent is extended or adjusted under 35 U.S.C. 154(b) by 0 days.

(21) Appl. No.: 09/622,882

(22) PCT Filed: Jan. 16, 1999

(86) PCT No.: PCT/DE99/00128

§ 371 (c)(1),
(2), (4) Date: Oct. 16, 2000

(87) PCT Pub. No.: WO99/43567

PCT Pub. Date: Sep. 2, 1999

(30) Foreign Application Priority Data

Feb. 24, 1998 (DE) ..... 198 07 768

(51) Int. Cl.[7] ..... B65D 51/18; B65D 51/20

(52) U.S. Cl. ..... 220/254; 220/254.2; 220/254.8; 220/257.1; 220/258.2; 220/361

(58) Field of Search ..... 220/254, 256, 220/257, 288, 796, 797, 798, 805, 361, 363, 601

(56) References Cited

U.S. PATENT DOCUMENTS

| | | | | |
|---|---|---|---|---|
| 4,746,025 A | * | 5/1988 | Krautkramer et al. | 215/232 |
| 5,052,568 A | | 10/1991 | Simon | |
| 5,176,278 A | * | 1/1993 | Quarberg | 220/256 |
| 5,566,864 A | * | 10/1996 | Stolz | 222/153.14 |
| 5,641,099 A | * | 6/1997 | McLelland et al. | 222/530 |
| 5,788,100 A | * | 8/1998 | Sturk | 215/258 |
| 5,823,377 A | * | 10/1998 | Krautkramer | 220/256 |
| 5,967,376 A | * | 10/1999 | Mcielland et al. | 220/153.06 |
| 6,095,382 A | * | 8/2000 | Gross | 220/254 |

FOREIGN PATENT DOCUMENTS

| | | |
|---|---|---|
| DE | 38 11 362 | 6/1989 |
| DE | 92 18 637 | 12/1994 |
| DE | 296 10 125 | 8/1996 |

OTHER PUBLICATIONS

EPC Allowance Documents—Communication under Rules 51(4) and 51(6).*
German language copy of allowed EPC claims.*
English Translation of EPC allowed claims.*

* cited by examiner

*Primary Examiner*—Lee Young
*Assistant Examiner*—Niki M. Eloshway
(74) *Attorney, Agent, or Firm*—Gerald K. White

(57) ABSTRACT

The present invention relates to a plastics lid of a container with a plastics closure fitted in an aperture of the lid, in particular a combination of the plastics lid (1) of a container and a plastics closure (2, 20) which is composed of a lower closure portion (2) with a closure foot (3), which can be fitted in an aperture of the lid (1), and a screw cap (20) which can be screwed on a pouring spout (17) of the lower closure portion (2), wherein the edge of the lid aperture is provided with an annular circumferential web (4) facing towards the outside of the lid, which is in engagement with the closure foot (3) fitted in the lid aperture, and closure foot (3) is configured U-shaped in cross-section, and grips around the web (4) with both U-arms (5, 6). In order to design a closure substantially only in two parts in combination with a lid such that in spite of a simple design, it offers a high degree of protection against tampering, furthermore the closure sealing capability is also guaranteed even under very rough transportation conditions, and in use the closure has a reliable functioning capability, it is proposed according to the invention that on the lid (1) a groove (10) surrounding the web (4) is provided, which is provided for engagement of the outer U-arm of the closure foot.

20 Claims, 12 Drawing Sheets

PLASTIC LID WITH PLASTIC SEAL

Figure 1:
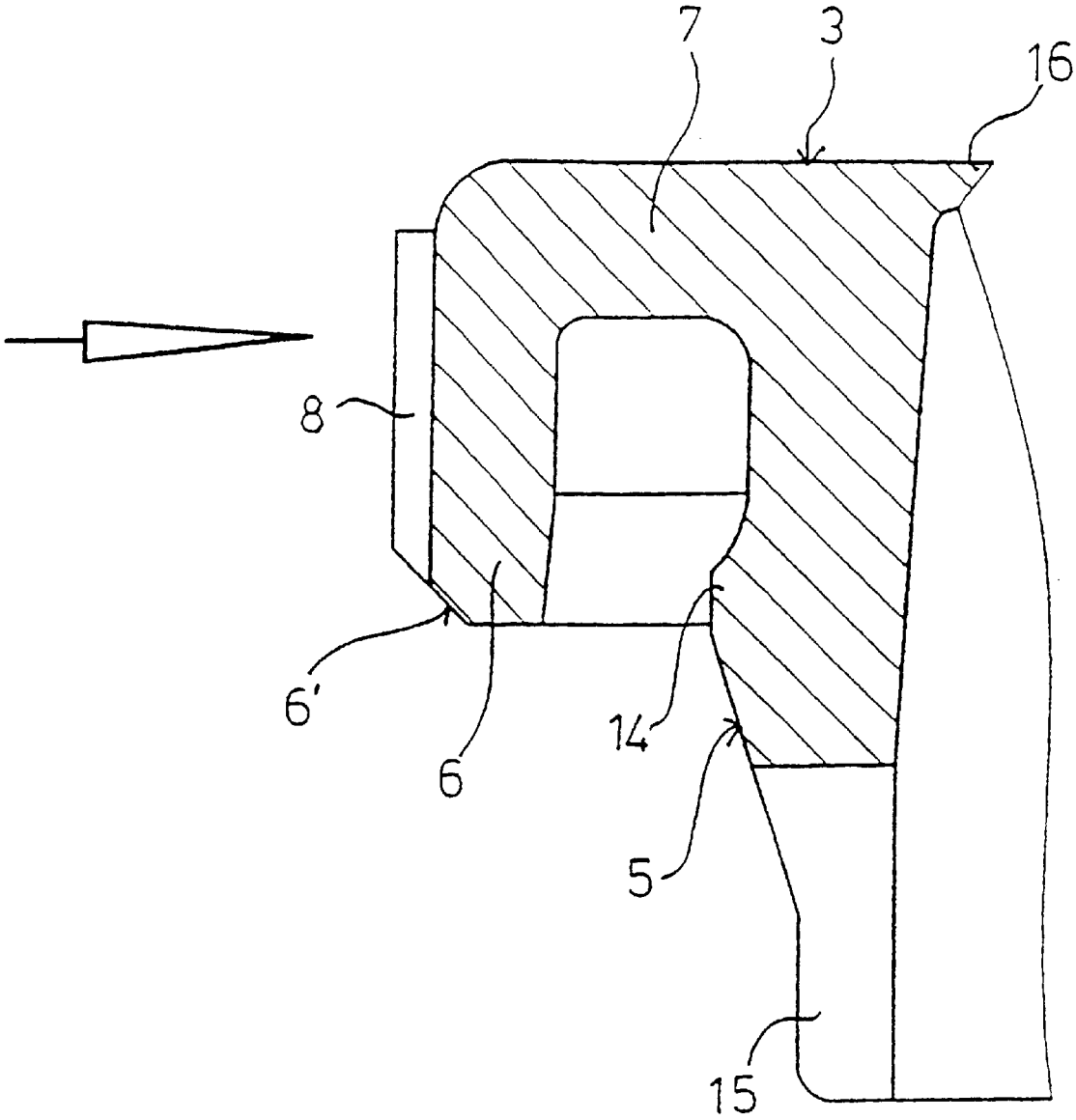

The present invention relates to a plastics lid of a container with a plastics closure fitted in an aperture of the lid.

More precisely, the invention relates to a combination of a plastics lid of a container and a closure which consists of a lower closure portion with a closure foot, which can be fitted in an aperture of the lid, and a screw cap which can be screwed onto a pouring spout of the lower closure portion, wherein the edge of the lid aperture is provided with a web going around in an annular manner, facing towards the outside of the lid, which web is engaged with the closure foot fitted into the lid aperture, and the closure foot is U-shaped in cross-section, and grips the web with both arms of the U, wherein a groove surrounding the web is provided in the container lid, in which groove the outer arm of the U-shaped closure foot engages.

Such a combination of a container lid and a closure is known from EP-A-0 620 160. With the combination according to the aforementioned publication, the area of a connector surrounding the aperture is set into the container lid, so between the connector and the surrounding container wall, a groove is formed. This is substantially wider than the portions to be received therein, as they have a bead that expands when they are placed on the connector of the container, which bead engages behind outward facing projections on the connector. Thus, within the relatively wide groove, the lower end of the closure foot, or respectively a ring additionally surrounding the closure foot, still remains easily accessible.

A screw ring for an aluminium container is known from FR-A-2 760 435, which is placed together with an additional outer container on the aluminium container, and in the process grips around the edge of the aluminium container, wherein engaging elements are provided between the outer container and the closure ring, which prevent relative torsion between the screw ring and the outer container.

When filling containers that are sealed with a corresponding combination of a plastics lid and plastics closure, there are various filling techniques, wherein a differentiation is made substantially between so-called "open-head filling" and "closed-head filling". With open-head filling, the container is firstly filled without a lid, and the lid, together with the closure already fitted into it, is placed on the container. In general this relates to a plastics bucket, the containers can, however, also be of sheet metal or other materials.

With closed-head filling, the lid, without the plastics closure, is firstly placed on the container, or else a container is used which is configured integrally with the lid of with its top, so an aperture for filling must necessarily be left in the lid of the container, into which aperture the plastics closure is fitted after filling. To this extent, the present invention also relates to combinations of a closure with a container or respectively a top of a container, when this is provided with the closure aperture, and is configured integrally with the container. The term "lid", to the extent to which the subject-matter of the present invention is concerned, is thus also to be understood as including also a top of said container, configured in one piece with the remainder of the container, and provided with the closure aperture.

While in the case of open-head filling it is, for example, possible to weld the closure foot or warranty elements of the closure to the lid before filling the container, so that in this way a secure connection between the closure and the container lid is obtained (see DE 35 28 815-A1 or DE 44 10 790-A1), such welding in the case of a closure that is fitted in a corresponding lid aperture only after filling of a container is generally no longer possible, or possible only with special configuration of the closure foot and web, as appropriate counter pads of welding tools cannot easily be used on the inside of the lid. In the case of so-called closed-head filling, more complex closure constructions are therefore generally selected, in order to be able to connect them as tightly a nd securely as possible to the web of the lid aperture. These more complex constructions are constituted, for example, in that the web has a radially outward facing flange portion, and/or projects sufficiently far from the lid surface to enable welding tools to be connected. In another known example, the web is provided on its outside surface with an external thread onto which there is screwed an external securing ring of the closure. The securing ring thus at the same time has a retaining function for the lower closure portion and, more precisely, for the closure foot of the lower closure portion, wherein the closure foot generally defines that portion of the lower closure portion which comes into engagement with the edge of the aperture or respectively with the web of the lid forming the edge of the aperture. In general this closure foot is L-shaped in cross-section, with an inner L-arm which defines an approximately cylindrical circumferential sealing web, which comes into engagement with the radial, internal portions of the edge of the aperture, and a flange portion which lies on the edge of the container aperture or respectively on the upper edge of the web of the lid and is held tightly thereupon by the securing ring.

Such a closure construction is relatively complex, however, as it requires, on the one hand, that the container lid has an axially relatively long cylindrical web, which is provided with an external thread, and as on the other hand, the closure additionally requires a further securing ring which, although it can initially be manufactured in one piece with the screw cap, must be separated from it in use, so these more complex closures are in the end composed of three portions, namely the lower closure portion, the screw cap (optionally with a ring pull), and the securing ring. A further disadvantage of almost all the container closures described hereinabove is that the web, and thereby also the closure, must project from the container lid relatively far in the axial direction. Such projecting closures are, however, subjected to very great stresses under certain conditions during transportation, which could lead to leaks or require additional expensive measures for ensuring the sealing of the closure, for example, in the form of raised container sides, which effectively form an indentation in the lid, in which the closure can correspondingly be received, appropriately protected.

In the case of other known embodiments, a cylindrical section of the closure foot fitted in a sealed manner in the web is also provided with one or more radially outward facing latching projections, by means of which the closure foot is to be held securely in the lid aperture.

In the case of this variant as well, from which the present invention proceeds (see FIGS. 6 and 7 of DE 35 42 769 A1), web and closure foot are axially configured relatively long in order to guarantee the necessary sealing capability. Furthermore, in the case of this known combination of lid and closure as well, the web on the edge of the lid aperture projects in the axial direction far above the surrounding surface of the container, so during transportation, in particular when the container falls onto the floor with the closure facing downwards, which is tested by means of appropriate drop tests in order to satisfy requirements laid down nationally or internationally, the closure is subjected to very great stresses which affect the sealing capability of the closure.

Closures have already been known, however, in which the closure foot is configured U-shaped in cross-section and grips around the web of the aperture edge of the container, as has also long been known for metal containers, which are provided, instead of the web, with a flanged aperture edge which is gripped around by the U-shaped closure foot of a plastics closure.

With this closure, however, an outer securing ring is also provided, in a manner analogous to the securing ring already described hereinabove, which outer securing ring is mounted on the U-shaped closure foot and holds it in a snapped-on engagement with the edge of the web.

A further disadvantage of the latter and of other known, non-welded closures, is also that twisting of the closure foot in the container aperture is possible as the edge of the container aperture and of the closure foot are as a rule configured rotationally symmetrical. Particularly when the thread area of the pouring spout and/or of the screw cap comes into contact with the medium filled into the container after first-time use, the threads of the screw cap and the pouring spout can easily stick, which makes unscrewing of the screw cap difficult and in the case where when attempting to open the screw cap, the closure rotates with it, makes opening the container almost impossible.

Compared to the prior art discussed hereinabove, the object of the present invention is to provide a closure substantially in two parts only, in combination with a lid such that in spite of simple design, a high degree of protection against tampering is offered, moreover the sealing capability of the closure is guaranteed even under very rough conditions of transportation, and in use, the closure has the ability to function reliably.

This object is solved in that the outer arm of the closure foot engages suitably in the groove in a manner such that its lower edge is protected from external access, and that in the area of the groove and in the area of the outer arm of the closure foot engaging in the groove, mutual engaging elements are provided which at least limit relative twisting of the closure foot with respect to the lid.

As the outer arm of the U of the closure foot engages in the groove surrounding the inner web, the lower edge thereof is protected from external access, which makes it difficult, if not impossible, to lever the closure foot out of the container aperture. This is all the more the case when, for example, the closure is a bellows closure and the bellows is still telescoped in the container aperture. In this state, because of the inwardly acting support by the telescoped bellows, the pouring spout telescoped with the bellows, and the screw cap screwed onto the pouring spout, the closure foot has a high degree of rigidity and stability of shape. When the telescoping out of the bellows is prevented by suitable measures, the closure is thus well protected from tampering.

Moreover, the holding of the closure foot on the web is clearly improved by engagement of the outer arm of the U of the closure foot in the groove.

By means of the U-shaped engagement of the web with the closure foot, it is moreover possible to also manufacture a sealed engagement between the closure foot and the edge of the aperture without an additional securing ring.

An embodiment of the invention is preferred in which the groove surrounding the web is configured such that a second web parallel to the first web extends away from the container surface, and runs around the first, inside web in an annular manner. The two tabs thereby enclose not only the outer arm of the U of the closure foot and protect it from access, but effectively produce stiffening of the aperture edge and thereby substantially contribute to the stability of the closure and to the sealing capability of the closure, for example, when the container falls over. The fact that with this the webs extend axially upwards from the surface of the lid is generally of no importance, as with many containers of this sort, the outer edge of the lid is in any case provided with a web or flange portion so that the lid surface is lowered overall with respect to the edge of the lid. In this case, the base of such containers also generally has a continuous web on which the container stands. When such containers are stacked, the closure of the container arranged underneath is therefore received in the hollow space thus configured on the underside of the container stacked above it, even when the closure area of the lid projects. Further, the two webs together with the U-shaped closure foot provide for the overall satisfactory stability of the closure even during high degrees of mechanical stresses, without the sealing capability of the closure being affected.

Advantageously, the inner web is somewhat shorter, and respectively more shallowly configured, than the outer web, wherein in the preferred embodiment of the invention the measured difference of the heights (in the axial direction of the closure) approximately corresponds to the thickness of the flange portion which joins the two arms of the U of the closure foot. As a result, this means that the surface of the closure foot, or respectively of the flange portion of the closure foot, terminates approximately flush with the upper edge of the outer web, when the closure foot is placed on the inner web and grips around it in a U-shape, wherein the outer arm of the U engages in the groove formed between the two webs.

In an embodiment very similar in principle, the groove is not configured in that a second continuous web is provided, but instead the groove is manufactured by a depression in the area surrounding the edge of the lid aperture, wherein the inner web forms the inside wall of this groove. At the same time, with such an embodiment, the entire aperture area, that is to say the surroundings of the depressed groove, can again be raised somewhat above the level of the lid, so the edge of the aperture is configured approximately S-shaped in profile. In this way it is ensured that in spite of the lowering of the of the edge of the aperture to form the groove surrounding the web, good emptying of the residual contents in the container is possible as the groove area is raised overall with respect to the level of the lid, such that only very little of the material located in the container and to be poured out can collect behind the walls of the groove.

In the case of the latterly described embodiment, the depth of the groove, measured from the area of the lid surface radially surrounding the groove outside the lid aperture, is greater than the height of the web measured from the base of the groove. This means that the closure foot does not project, or projects only slightly, with its uppermost portions above the lid surface, so stressing of the closure during transportation, and during drop tests simulating rough transportation conditions, remains ineffective.

A variation of this embodiment is particularly preferred in which the difference between the height of the web and the depth of the groove approximately corresponds to the thickness of the flange portion joining the two arms of the U of the closure foot. This means that the upper outer surface of the closure foot formed by this flange portion terminates flush with the surface of the lid adjoining the groove, when the closure foot is placed on the web or respectively is fitted with its outer U-arm in the groove surrounding the web. It is naturally a prerequisite with this that the axial length of the outer U-arm does not exceed the depth of the groove.

In the preferred embodiment of the invention, engaging elements ensure that the screw cap can be unscrewed from the pouring spout of the lower closure portion, without the lower closure portion rotating with the screw cap, which conventionally is ensured only by welding or by means of the additional, but expensive, retaining ring, which retains the rotationally symmetrical closure foot on the web of the container edge.

Protection against twisting, in the form of the engaging elements, ensures problem-free handling of the closure in use, in particular when a relatively tight screw cap is unscrewed. The screw cap can, for one thing, be in very tight engagement with the external thread of the pouring spout because of a correspondingly slightly widened pouring spout, in the case of swelling contents which produce a certain over-pressure in the container. Moreover, it can occur that in particular in the case of adhesive contents, after pouring the liquid out, part thereof remains adhering to the upper edge of the pouring spout or, after repeated use, also on the inside of the screw cap. When these, possibly adhesive contents, come into the thread area, the screw cap can only be loosened with a certain amount of force. In this case, the engaging elements contribute to holding the closure foot, and thereby the entire lower closure portion on the container or respectively in the container lid, so the force required can be applied to the screw cap without the lower closure portion rotating with the screw cap.

The pouring spout is, in the preferred embodiment of the invention, connected to the closure foot by means of a bellows which can be telescoped in and out, wherein the bellows and spout are dimensioned such that with a telescoped-in closure, the bellows terminates approximately flush with the surface of the flange portion of the closure foot. A screwed-on screw cap, the end wall of which projects in a radial direction above the closure foot, lies flat on the closure foot, and optionally also still on the lid surface surrounding the closure foot, when the bellows is telescoped-in, and said cap is in the condition in which it is screwed onto the pouring spout.

In connection with the embodiments previously described, in which a web surrounding the lid aperture and the groove is provided in the lid, the engaging elements mutually provided on the lid and on the closure foot can be fitted particularly advantageously and effectively. Preferably, engaging elements on the closure foot are provided on the outer U-arm of the closure foot, and the engaging elements on the lid are preferably provided on the wall sections or respectively the base of the groove, which elements preferably lie opposite the engaging elements on the outer U-arm. The engaging elements can, however, also be provided on the flange portion of the closure foot and the web, and possibly even on the inner U-arm of the closure foot and the web. As the inner arm of the closure foot and the web must, however, be in as tight as possible engagement with one another, in order to ensure the sealing capability of the closure, an embodiment of the closure is preferred in which the engaging elements are provided on the radially outer surface of the outer arm of the closure foot, and on the radially inner surface of die outer wall of the groove. Provision of the engaging elements on the axially free end of the U-arm and on the base of the groove would also possibly be suitable, This would to actually also be possible were the groove interrupted in one or more places, and at suitable places interruptions in the outer U-arm of the closure foot were provided, by means of which a twist-proof engagement between the closure foot and the lid would be retained. These interruptions would not necessarily have to extend over the entire axial length of the groove or respectively the outer U-arm.

Proceeding from the preferred variation, in which the engaging elements are provided on the outside of the outer arm of the U and on the inner side of the outer wall of the groove, a configuration of the invention is preferred in which seen in radial plan view (line of sight parallel to the radius of the lid aperture) the engaging elements on the lid come together, tapering upwards, while in a radial plan view the engaging elements on the outer wall of the outer U-arm come together, tapering downwards. This means that when the closure foot is placed on the web, which means the same as the outer U-arm of the closure foot being fitted in groove surrounding the web, the engaging elements do not mutually interfere or interfere only a little, wherein this effect is obtained above all when, in plan view, the engaging elements have the shape of an acute triangle. When the closure foot is placed on the web the tips of the acute triangles are then facing one another and thus very easily pass by one another, wherein in the case of a touching of the side walls of these projections, the closure foot is again rotated somewhat in one or other direction relative to the lid until the closure foot sits completely on the web. Naturally, the triangular shape of the projections does not have to be strictly adhered to, and the sides of these triangles can also be convexly or concavely bowed, without losing the advantages of the tapered and acute shape.

Moreover, an embodiment of the invention is preferred in which the inner arm of the U-shaped closure foot is provided on its radially outer side with a circumferential ring bead. In a corresponding manner, the web of the lid has to have a radially inward projecting circumferential projection, which, when the closure foot is placed on, is gripped from behind by the ring bead on the inner arm of the closure feet. Preferably, the radially inward projecting projection on the web of the lid has a more or less acutely tapering nose-shape, so along this point a very narrow, almost linear and continuous area of engagement between the nose-shaped projection on the web and the outside surface of the inner U-aim is produced, which leads to a relatively large amount of pressure on this narrow engagement surface, so that in this way a very good sealing capability of the closure is obtained.

Figure 2:
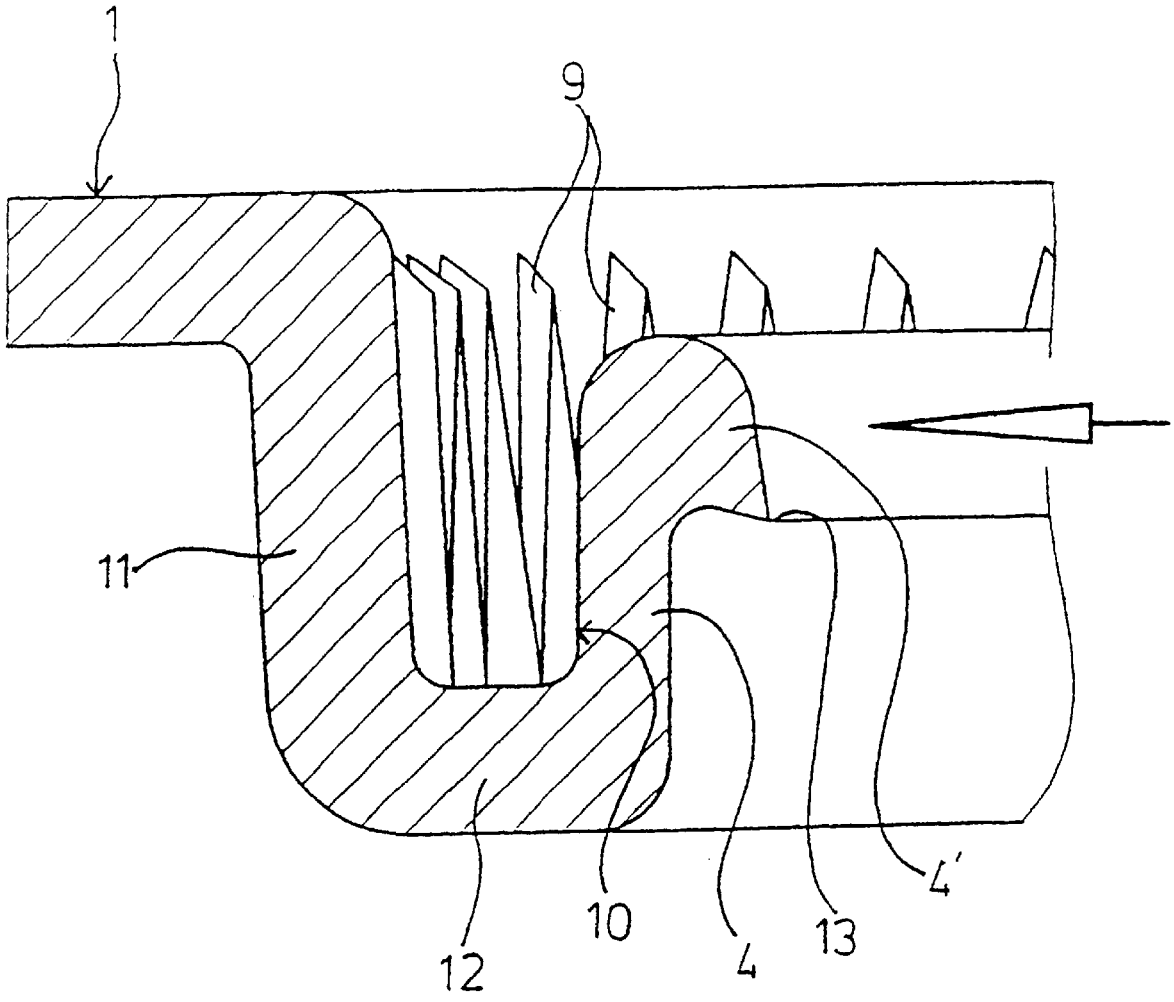
Figure 3:
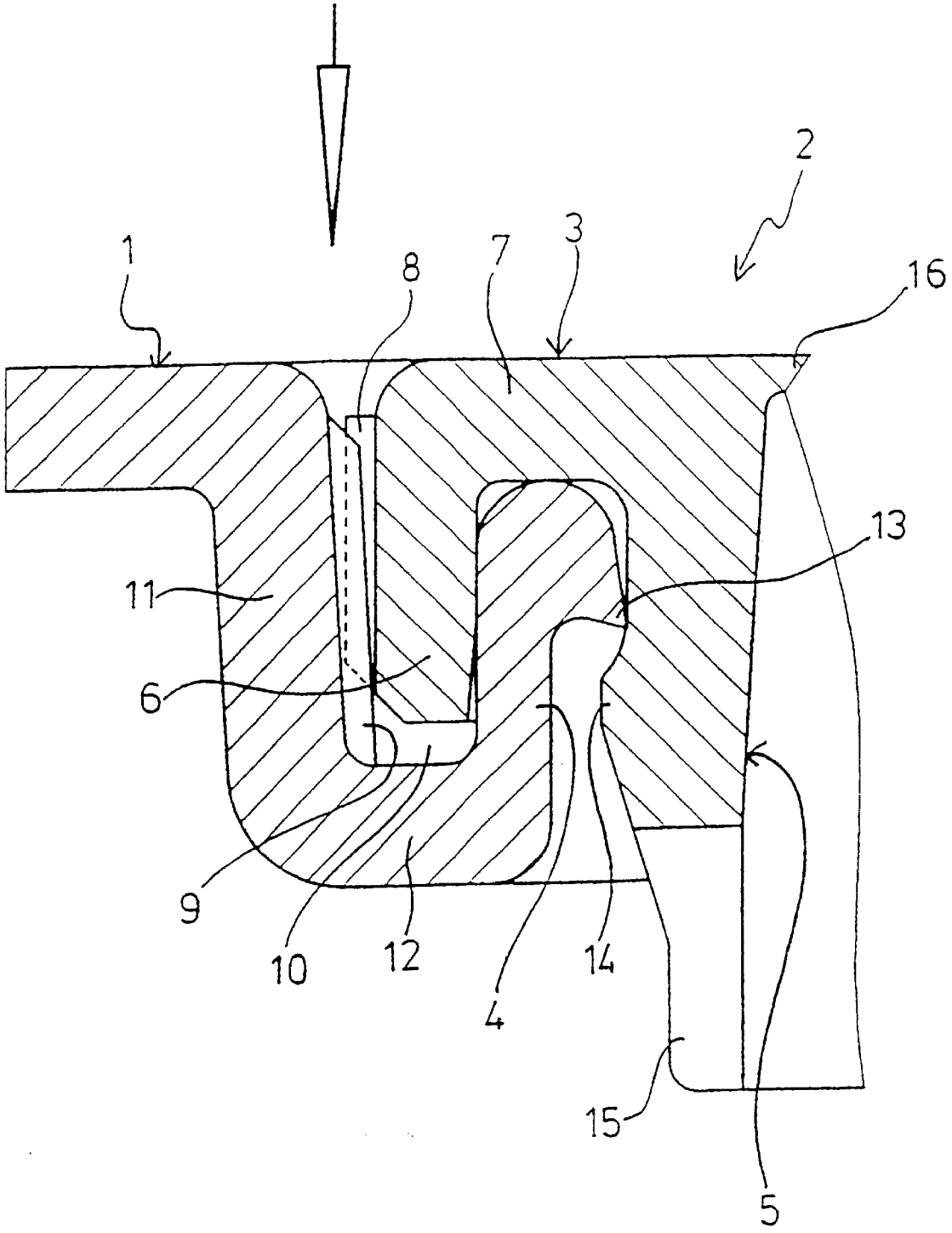
Figure 4:
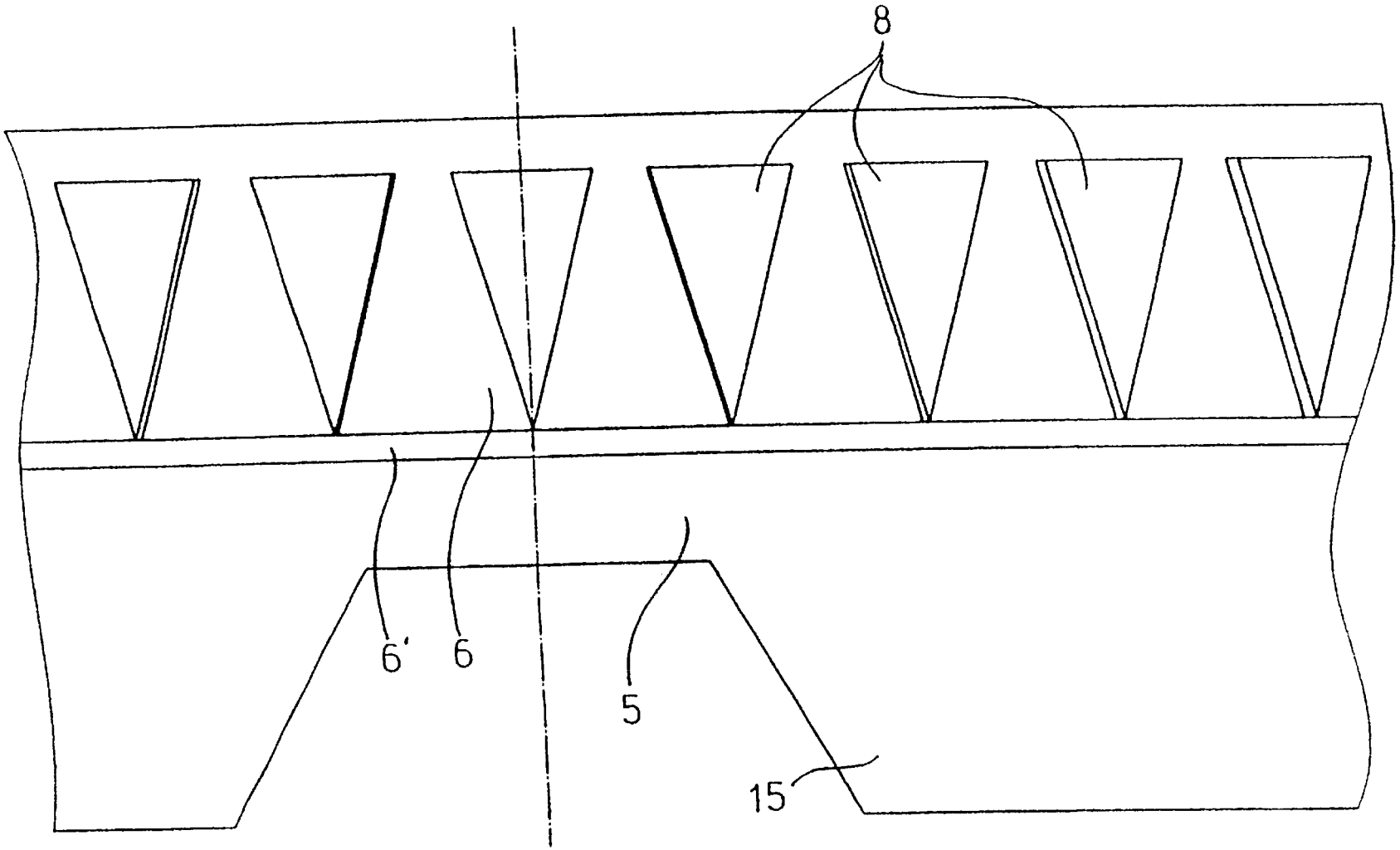
Figure 5:
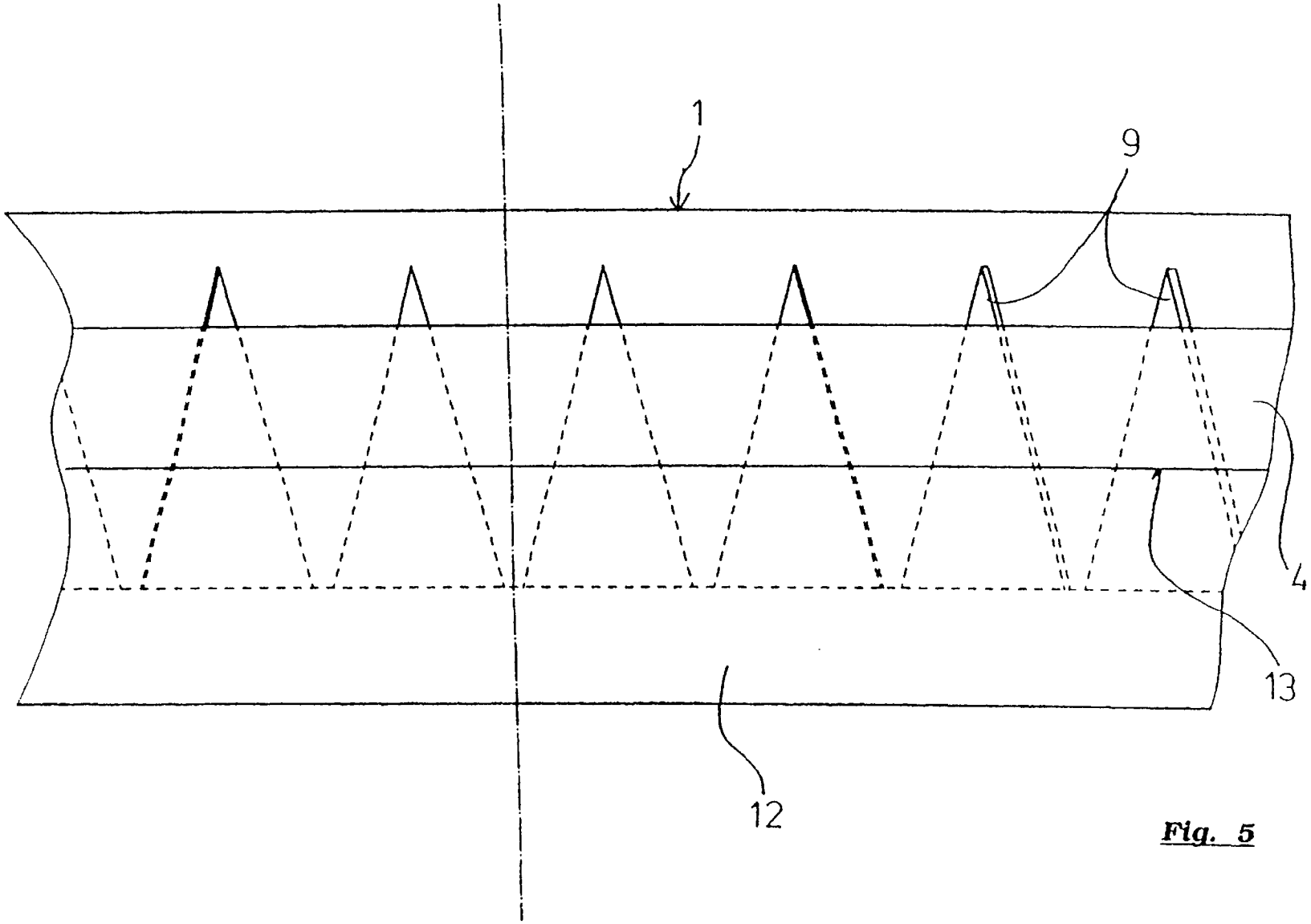
Figure 6:
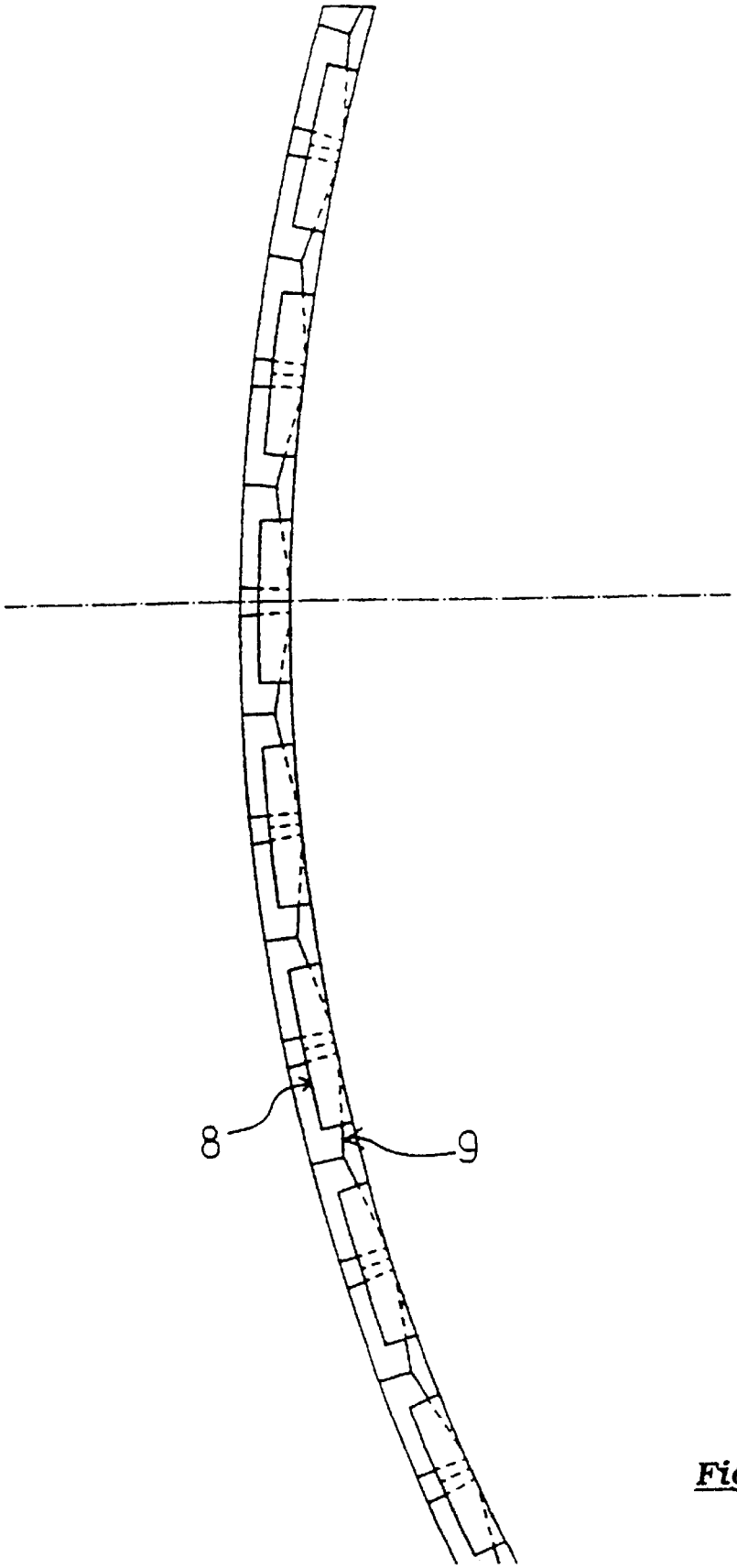
Figure 7:
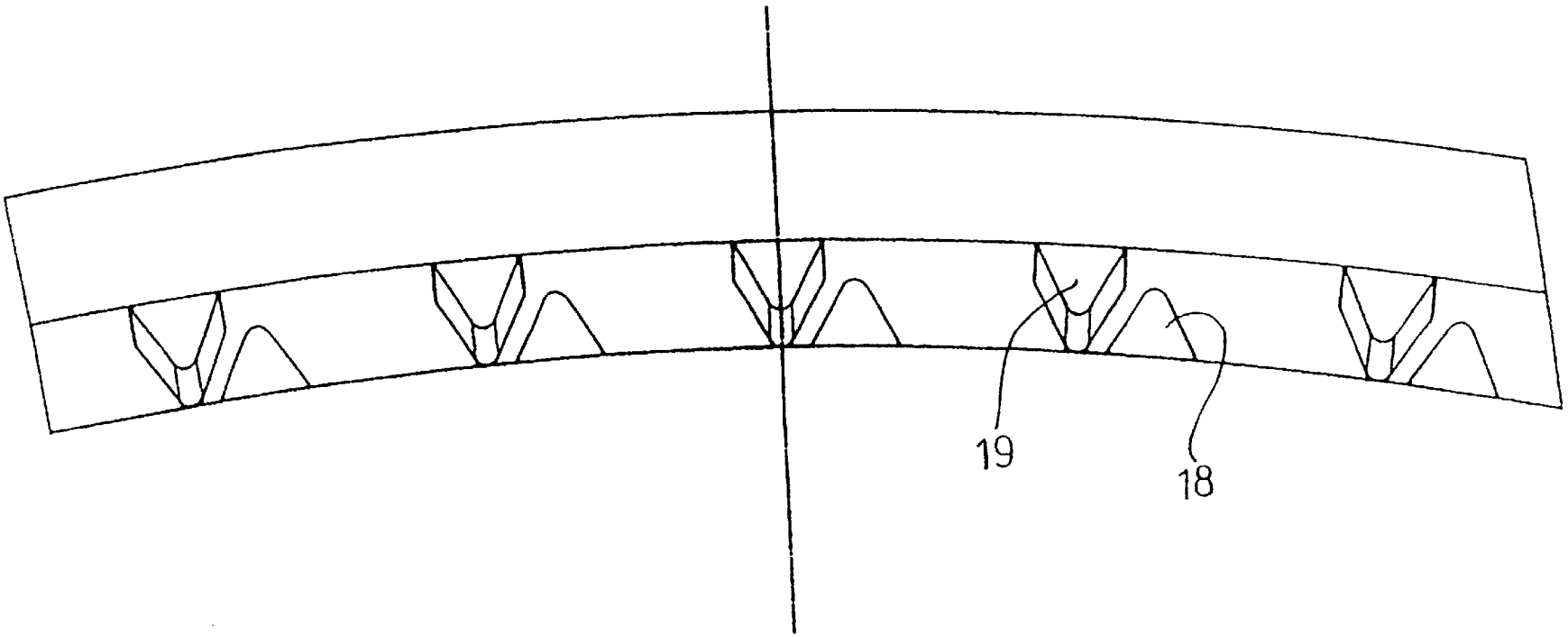
Figure 8:
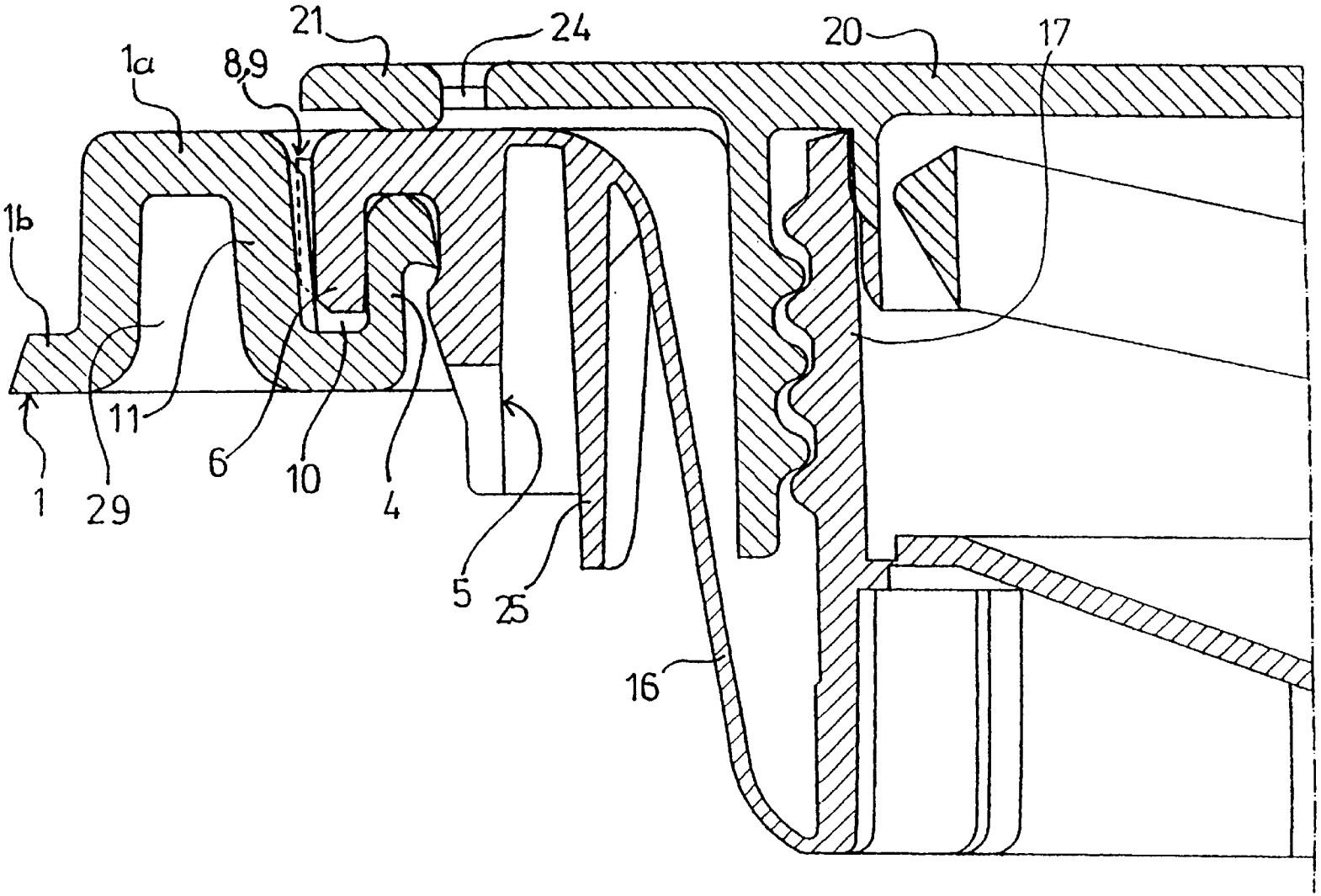
Figure 9:
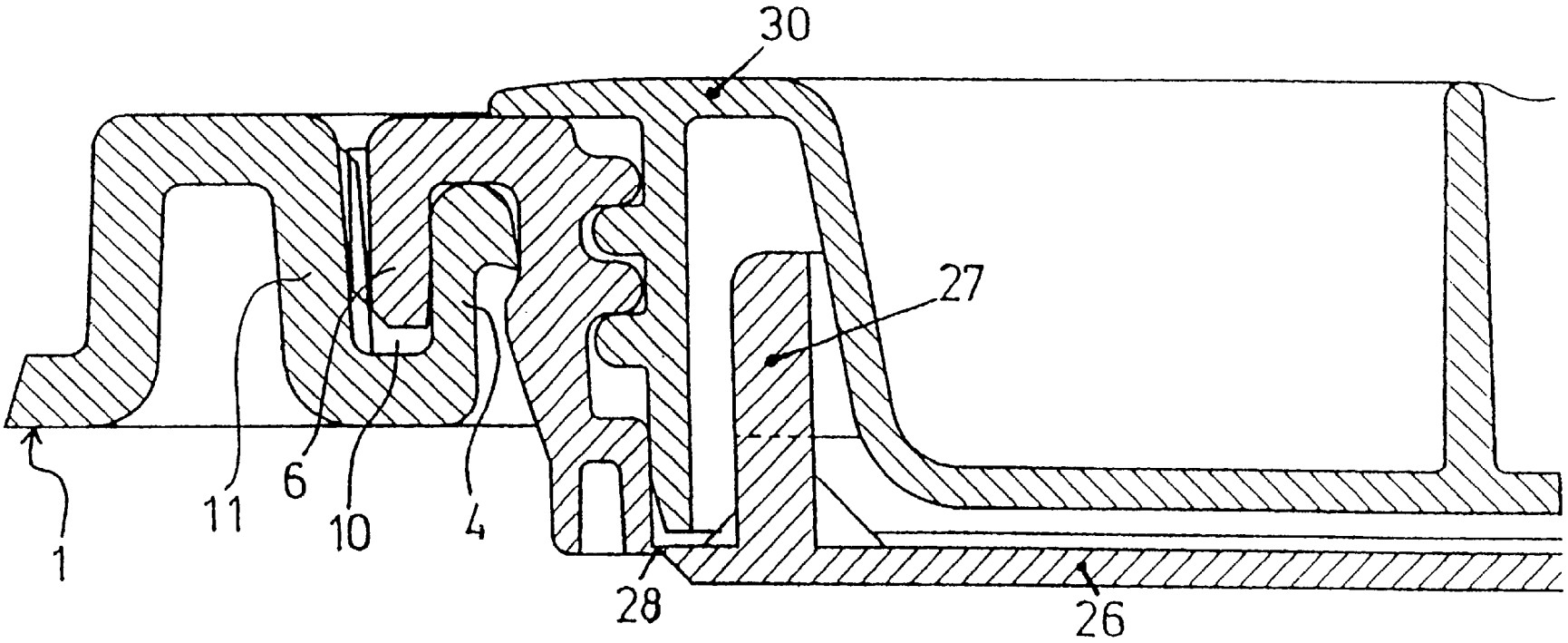
Figure 10:
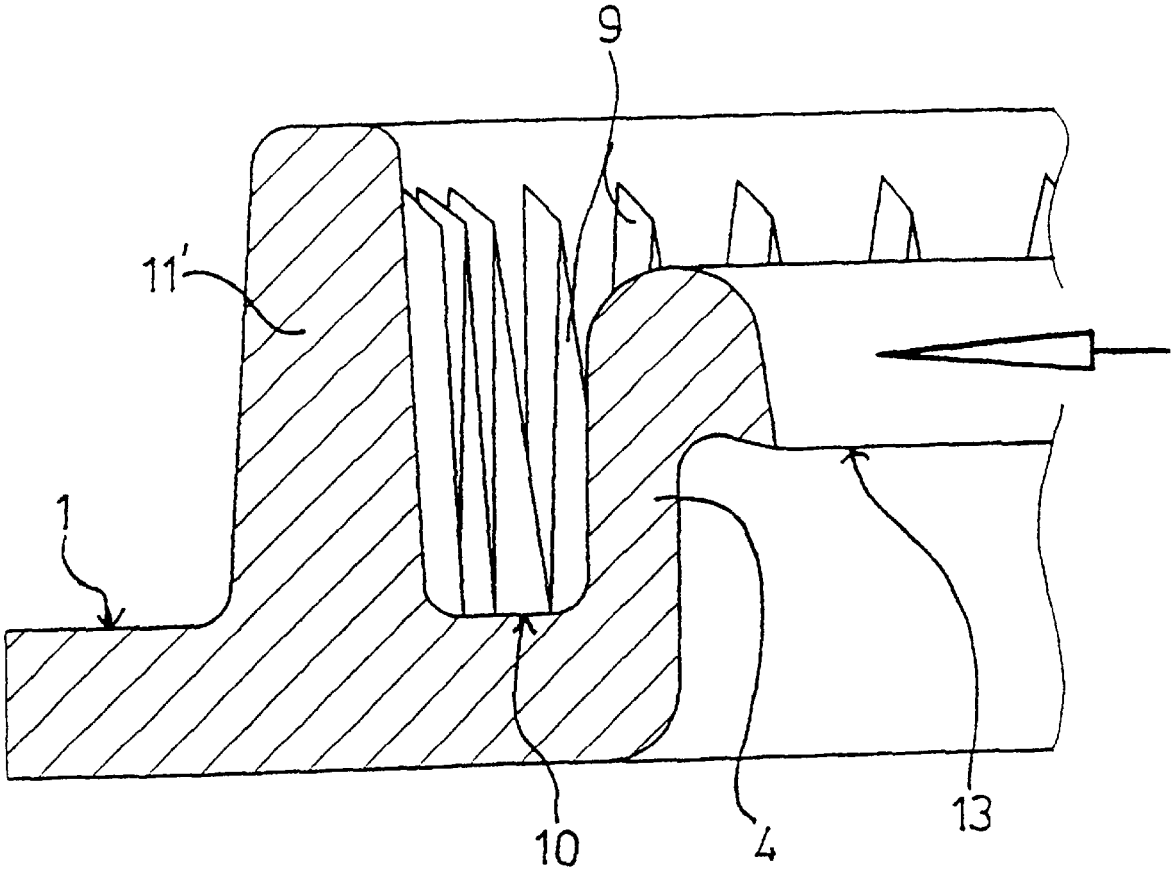
Figure 11:
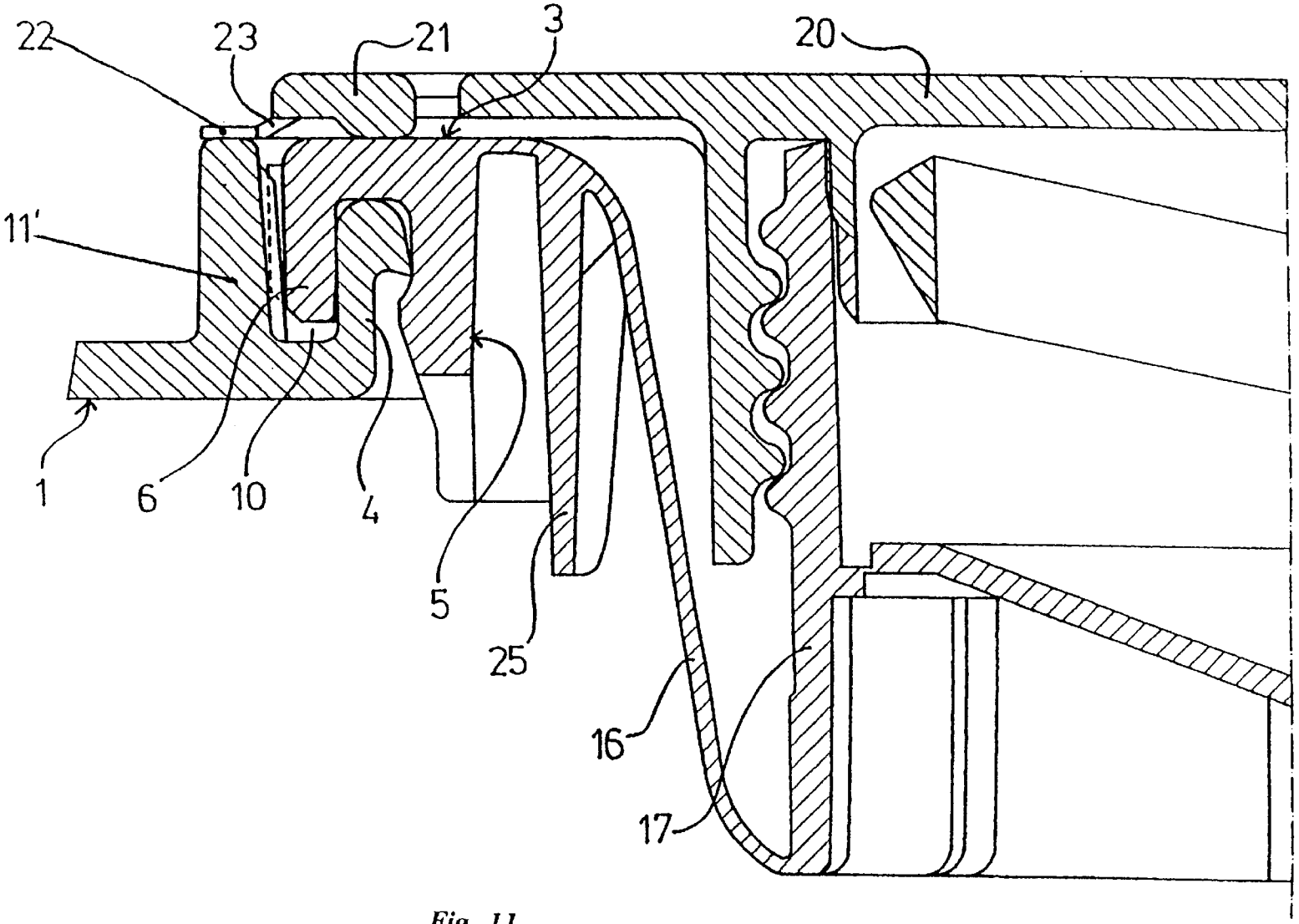
Figure 12:
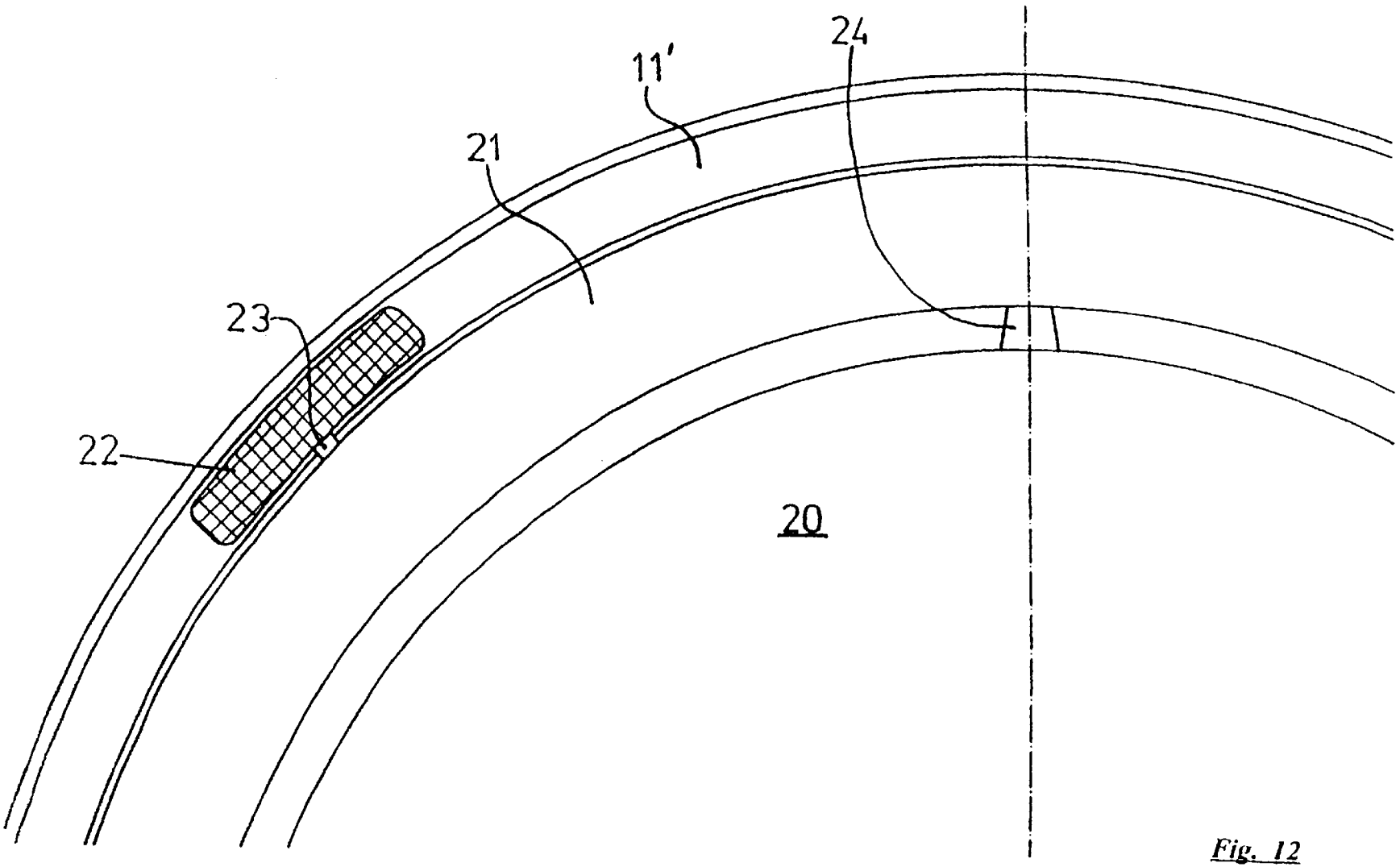

Further advantages, features and possibilities for application of the present invention will become clear with reference to the following description and the associated drawings. In these is shown, in:

FIG. 1 a section through the closure foot of a closure shown detached,

FIG. 2 in section, the edge of a lid aperture,

FIG. 3 again in section, and cut-away, the closure foot placed on the web of the container aperture, FIG. 4 a cut-away of a closure foot according to FIG. 1, in a radial side view, FIG. 5 a side view radially from the inside of the cut-away edge of a container aperture, FIG. 6 a plan view of a section of the gap remaining between the closure foot and the outer wall of the groove, with the engaging elements which can be recognised therein, FIG. 7 a view similar to FIG. 6, with an alternative design of the engaging elements, FIG. 8 an axial section through a closure fitted into a lid aperture, of the embodiment according to FIGS. 1 to 7, FIG. 9 a further section through a closure fitted in a lid aperture, in an embodiment without a bellows, FIG. 10 another preferred embodiment of the aperture edge of a container lid, partly in section, FIG. 11 a section through the aperture edge according to FIG. 10, with a fitted bellows closure, and FIG. 12 a plan view of a part of a closure according to FIG. 11.

There is shown in FIG. 1 a part of a lower closure portion substantially composed of a closure foot 3, wherein a bellows 16, recognisable only when extended, connects onto the closure foot 3, which bellows in turn is joined to a pouring spout not shown in FIG. 1. The closure foot 3 has a substantially U-shaped cross-section with an inner U-arm 5, and outer U-arm 6, and a flange portion 7 joining the two U-arms 5, 6. The inner U-arm 5 has interruptions in its lower free section, which interruptions alternate with extension sections 15 of the U-arm 5 and are to make possible as complete as possible emptying of the container. On the radially outer side of the inner closure foot 5, a projection, approximately trapeze-shaped or triangular in cross-section is provided. The outer U-arm 6 is substantially straight in cross-section, but has on its outside projections 8 of which only one is shown in a side view in FIG. 1, and which will be described in more detail later. As is evident, the lower free end of the U-arm 6 is provided with a slope 6' and thus tapers in a wedge-shape at the free end, and this slope 6' also extends as far as the tip of the engaging element 8, which facilitates the fitting of this U-arm in the circumferential groove formed on a container lid.

FIG. 2 shows in section, and partially in cross-section, the edge of a lid aperture which is to engage with the closure foot described with reference to FIG. 1. In detail, there is shown a web 4, which is surrounded by a circumferential groove 10, and which is provided with a radially inward projecting, and in cross-section nose-shaped, projection 13. In this way the upper end of the web 4 is thickened to form a bead 4', wherein this bead 4' is provided with a projection, nose-shaped in cross-section, defining a point or respectively an edge 13 which defines the radially innermost part of the edge of the aperture in the lid 1. The radially inner surface of the outer groove wall 11 has engaging elements 9 in the form of triangles tapering upwards or respectively coming together in a point. The horizontal section of the container wall, defining the base of the groove 10, is labelled 12.

In FIG. 3, the two parts shown individually in FIGS. 1 and 2 are shown in a combined state. It is evident that the closure foot 3, U-shaped in cross-section, grips around the web 4, and that vice-versa, the outer U-arm 6 of the closure foot 3 is fitted in the groove 10 of the lid 1, which surrounds the web 4. At the same time the engaging elements 8, 9, triangular in plan view, have come into mutual engagement with one another, and thus prevent relative twisting of the closure foot 3 and thereby the whole lower closure portion 2 with respect to the lid 1. The bead 14 on the outside of the inner U-arm 5 has gripped behind the edge 13 of the nose-shaped projection on the bead-shaped thickened upper end of the web 4, and the upper concave flank of the bead 14 is in tight, sealed engagement with the nose-shaped projection 13 which is relatively pointed in cross-section.

The projections 8 on the outer U-arm 6 of the closure foot 3 are particularly clearly shown in the radial side view according to FIG. 4. Here, the individual projections 8 are arranged spaced apart from one another, which allows the arrangement between them of the engaging elements 9 of the lid with clearance, which elements are shown in a corresponding side view on FIG. 5. FIG. 5 is a cut-away of a view radially from the inside towards the edge of the lid aperture. In the plan view, there is shown the web, or respectively the upper part of the web thickened in a bead-like manner, with the nose-shaped projection, the lower edge 13 of which is recognisable as a horizontal line. The web 4 then partially covers the engaging elements 9 so they are shown only in broken lines in their lower region, while the points of these triangular projections are completely visible and therefore shown with solid lines. The dimension of the projections 9 is then exactly the same as the dimension of the projections 8 on the outer U-arm 6 of the closure foot 3.

As can easily be imagined with reference to FIG. 3, it would have been equally possible to provide corresponding projections on the base of the groove 10 and on the free ends of the outer U-arm 6 lying opposite this groove base.

FIG. 6 is a view from above of the gap also shown in FIG. 3, which remains for engaging elements 8, 9 between the outer U-shaped 6 and the outer wall 11 of the groove 10. It will be evident from this that the triangular engaging elements 8, 9 of the lower closure portion 3 on the one hand, and of the lid 1 on the other hand, engage in one another with some clearance. Furthermore, it is evident in this drawing that the thickness of the engaging elements measured in the radial direction only decreases towards the point in the case of the engaging elements 9 of the lid. This feature also acts to facilitate the introduction of the outer U-arm 6 with its engaging elements 8 in the groove 10, which surrounds the web 4 of the container lid.

In FIG. 7 yet another variation of engaging elements is shown in a view similar to FIG. 6. In this case, the engaging elements 18, 19 are projections which come together in a tapering manner in the radial direction, tapered outwards in the radial direction in the case of the engaging elements 18, and in the case of the engaging elements 19, tapered inwards in the radial direction. In the axial direction, the engaging elements 18, 19 have a respectively constant cross-section. A sufficient clearance between these engaging elements then ensures a simple connection of the closure foot and web, or respectively the aperture edge of the lid.

In FIG. 8 is shown in section a closure fitted into a container aperture, wherein also a part of the region of the container lid 1 surrounding the groove 10 is also shown, and the closure is shown in section as far as the central closure axis.

It is to be emphasised that, compared to FIGS. 1 to 7, a larger section of the lid 1 is shown in FIG. 8, so it is evident that the section 1*a* of the lid immediately surrounding the groove 10 is raised with respect to the surface of the rest of the lid region 1*b*, this being by approximately the size of the depth of the groove 10. The screw cap 20 is also shown as a further closure portion, which is screwed onto the pouring spout 17, wherein the latter is connected via the bellows 16 to the closure foot 3. Ventilation elements 25 are also evident on the bellows 15, in the vicinity of the closure foot 3, which elements project radially inwards when the bellows is telescoped out, wherein between these ventilation elements 25, ventilation apertures are left free, while the central aperture formed by the ventilations elements 25 defines the actual pouring aperture for a liquid or the like.

In order to pull out the bellows 16, the screw cap 20 is also provided with a ring pull which is partially connected to the screw cap by tabs 24 easily tearable by hand, and also partially by hinge-like, fixed connections (not shown).

In order to pull out the bellows 16 with the pouring spout 17, the ring pull 21 is raised with respect to the screw cap 20, wherein the manually tearable tabs 24 are torn and the ring pull only remains attached to the screw cap 20 by means of its ends, preferably in opposite regions of said screw cap. In the ring pull 21 either one or two fingers can be engaged in order to pull out the screw cap 20 and with the screw cap 20 the pouring spout 17 connected to said screw cap by means of the threaded engagement, wherein the bellows 16 is telescoped out and the ventilation elements 25 are unfolded so that the project approximately radially inwards when the pouring spout 17 is completely telescoped out.

The engagement of the U-shaped closure foot 3 on the web 4, and also the engagement of the outer U-arm 6 in the groove 10, also ensure that the closure foot 3 is securely held on the web 4 or respectively the aperture edge of the container lid 1.

For pouring, the container is inclined or respectively turn upside-down, wherein the contents of the container can be substantially completely poured out of the container. In particular, it is to be emphasised in this context that the inner U-arms 5 of the closure foot 3, which project some way into the interior of the container, are interrupted on their ends, as is clearly shown by the absent hatching in FIG. 8, so the flowable material otherwise collecting behind the inner U-arms can flow through these gaps between the individual axial projections of the U-arms 5. Although a small residue of the liquid can still collect in the internal groove 29 of the lid 1, which is formed by the raising of the area 1*a* compared to the remaining area 1*b* of the surface of the lid, the volume of this groove 29 is relatively small so in this region only a little liquid can collect, and the container is substantially completely emptied.

FIG. 9 shows another similar variation, in which the aperture edge is identical to the aperture edge of the lid 1 shown in FIG. 8, but the closure fitted is different from the closure according to FIG. 8, however. In the embodiment of FIG. 9, the screw cap 30 has an external thread, and the U-arm 5' of the closure foot is provided with a corresponding internal thread. On the lower end of the inner U-arm 5' there is attached a membrane 26 with an annular membrane seal 27 by means of a manually easily tearable connection 28. In order to use this closure, the screw cap 30 is firstly unscrewed, then the membrane 26 with the annular seal 27 is separated along the tear line 28 from the closure foot 3, so subsequently the contents of the container are accessible. These types of closure are used, for example, for containers of wall paints where the membrane 26 is removed during sale or after sale in order to be able to mix colour pigments into the colour in the container. Subsequently, the screw cap 30 is closed again and the customer takes the appropriately coloured wall paint away.

In FIGS. 10 to 13 another particularly preferred embodiment of the invention is shown, in which the problem of emptying residual quantities is completely eliminated. With reference to FIG. 10, which shows the section through an aperture edge of a container lid 1, it is evident that in this case the groove 10 is not formed by lowering the lid region surrounding the web 4, but rather a second, radially outer web 11' is provided which is parallel to the web 4 already projecting axially from the surface of the lid 1 and radially outside it. In this way the underside of the lid is completely flat and allows the desired emptying of residual quantities as is also evident with respect to the example of FIG. 1, which shows the same aperture edge with a closure fitted. As is also evident here, on the one hand the two U-arms 5, 6 grip around the radially inner web 4, on the other hand the U-arm 6 also engages in the groove 10 which is formed between the webs 4 and 11'. In the same way as with the embodiments described hereinabove, engaging elements 8, 9 are also provided in this case, which prevent twisting of the closure foot relative to the container lid 1.

The inner web 4 is axially somewhat shorter than the outer web 11', so when the closure foot 3 is placed on, with this embodiment also the surface of the closure foot 3 terminates approximately flush with the upper edge of the outer web 11'. The underside of the container lid 1 is, as already described, substantially flat, and also the inner U-arms 5 of the closure foot project with their interrupted sections above inner container lid surface into the inside of the container, so they do not affect the flowing away of the material located in the container along the internal lid surface and through the pouring spout 17.

A peculiarity of the embodiment shown in FIGS. 11 and 12 is in the welding tab 22 provided, which is in turn connected to the pull ring 21 by easily manually tearable bridges or tabs 23. This tab 22 is provisionally fastened to the upper edge of the outer web 11', for example, by ultrasound welding or gluing. In the plan view the tab 23 is again emphasised by hatching. In this way, the lifting of the ring pull and all pulling out of the closure, including any pulling out of the closure foot from its engagement with the aperture edge of the container lid, is effectively prevented, as for this, the connecting tab 23 has to be torn, so a corresponding attempt at tampering would be visible afterwards. The tab or respectively the edge of the cap could also equally well be welded onto the flange portion 7 of the closure foot 3, as when the bellows is telescoped in, the closure in combination with the walls of the groove of the lid has such a high degree of rigidity that levering out of the closure foot 3 from the groove 10 is practically excluded.

In both embodiments shown, the aperture edge of the container lid 1 is relatively stiff and resistant to deformation either because of the S-shaped cross-section in the embodiments of FIGS. 1 to 9, or because of the double web 4, 11' extending perpendicular to the surface of the lid. In this way too, a solid, reliable and sealed engagement of the closure foot 3 on the aperture edge of the container lid 1 is guaranteed.

What is claimed is:

1. Combination of the plastics lid (1) of a container and a plastics closure (2, 20) which is composed of a lower closure portion (2) with a closure foot (3), which lower closure portion can be fitted in an aperture of the lid (1), and a screw cap (20) which can be screwed onto a pouring spout (17) of the lower closure portion (2), wherein the edge of the lid aperture is provided with an annular circumferential web (4) facing towards the outside of the lid, which is in engagement with the closure foot (3) fitted in the lid aperture, and the closure foot (3) is configured U-shaped in cross-section, and grips around the web (4) with both U-arms (5, 6), wherein on the lid (1) a groove surrounding the web (4) is provided, in which the outer U-arm of the closure foot engages, wherein the U-shaped closure foot grips around the web, characterised in that the outer U-arm of the closure engages suitably in the groove in the manner such that its lower edge is protected from external access, and in that in the region of the groove and in the region of the outer arm of the closure foot engaging in the groove, mutual engaging elements (8, 9) are provided which form a twist-proof engagement between said closure foot and said lid, thereby preventing rotation of said lower closure portion when force is applied to said screw cap.

2. Combination according to claim 1, characterised in that the web projects outwards from the lid, and in that a second web is provided parallel to and at a distance from the first web, and radially surrounding it on the outside, so that between these two webs the groove is defined in which the outer arm of the closure foot engages.

3. Combination according to claim 2, characterised in that the second, radially outer web is axially configured longer and respectively higher than the first, inner web.

4. Combination according to claim 2, characterised in that the height difference of the two webs approximately corresponds to the thickness of the flange portion (7) connecting the two U-arms (5, 6) of the closure foot (3).

5. Combination according to claim 2, characterized in that the screw cap of the closure or a ring pull connected to said screw cap extend at least partly radially beyond the outer web or respectively beyond the groove.

6. Combination according to claim 1, characterised in that the groove is formed by a depression in the lid surface in the immediate surroundings of the web, wherein the web forms the radially inner wall of the groove.

7. Combination according to claim 6, characterised in that the region of the lid surrounding the groove is raised with respect to the remainder of the lid surface by an amount which corresponds at least to approximately the groove depth, measured from the lid surface immediately surrounding the groove.

8. Combination according to claim 7, characterised in that the depth of the groove (10), measured from the region radially surrounding the groove outside the lid aperture, is greater than the height of the first web (4) measured from the base of the groove (10).

9. Combination according to claim 8, characterised in that the difference between the height of the web (4) and the depth of the groove (10) approximately corresponds to the thickness of the flange portion (7) connected the two U-arms (5, 6) of the closure foot (3).

10. Combination according to claim 8, characterised in that the engaging elements are provided in the form of interruptions in the groove (10) and the outer U-arm (6) of the closure foot (3).

11. Combination according to claim 6, characterised in that the depth of the groove (10), measured from the region radially surrounding the groove outside the lid aperture, is greater than the height of the first web (4) measured from the base of the groove (10).

12. Combination according to claim 11 characterised in that the difference between the height of the web (4) and the depth of the groove (10) approximately corresponds to the thickness of the flange portion (7) connected the two U-arms (5, 6) of the closure foot (3).

13. Combination according to claim 11, characterised in that the engaging elements are provided in the form of interruptions in the groove (10) and the outer U-arm (6) of the closure foot (3).

14. Combination according to claim 1, characterised in that the engaging elements (9) provided on the lid (1) come together upwards in the radial plan view, and the engaging elements (8) provided on the closure foot (3) come together in a tapering manner downwards in radial plan view.

15. Combination according to claim 1, characterised in that engaging elements provided on the closure foot (3) are provided on the outer U-arm (6) of the closure foot (3).

16. Combination according to claim 15, characterised in that the engaging elements on the closure foot (3) are provided on the radially outer peripheral surface of the outer U-arm (6) of the closure foot (3), and the engaging elements (9) of the lid (1) on the radially inner surface of the outer groove wall (11) of the groove (10).

17. Combination according to claim 1, characterised in that the engaging elements are respectively provided as projections projecting radially inwards (9) and radially outwards (8), which have the shape of acutely-angled triangles in plan view.

18. Combination according to claim 1, characterised in that the inner arm (5) of the U-shaped closure foot (3) is provided with a circumferential external annular bead (14).

19. Combination according to claim 1, characterised in that the web is provided with a circumferential projection (13), projecting radially inwards, and approximately nose-shaped in cross-section.

20. Combination of the plastics lid (1) of a container and a plastics closure (2, 20) which is composed of a lower closure portion (2) with a closure foot (3), which lower closure portion can be fitted in an aperture of the lid (1), and a screw cap (20) which can be screwed onto a pouring spout (17) of the lower closure portion (2), wherein the edge of the lid aperture is provided with an annular circumferential web (4) facing towards the outside of the lid, said web is provided with a circumferential projection (12) projecting radially inwards, and approximately nose-shaped in cross-section, said web is in engagement with the closure foot (3) fitted in the lid aperture, and the closure foot (3) is configured U-shaped in cross-section, and grips around the web (4) with both U-arms (5,6), in which the inner arm (5) of the U-shaped enclosure foot (3) is provided with a circumferential external annular bead (4), wherein on the lid (1) a groove surrounding the web (4) is provided, in which the outer U-arm (6) of the closure foot engages, wherein the U-shaped closure foot grips around the web, characterized in that the outer U-arm of the closure engages suitably in the groove in the manner such that its lower edge is protected from external access, and in that in the region of the groove and in the region of the outer arm of the closure foot engaging in the groove, mutual engaging elements (8,9) are provided which at least limit relative twisting of the closure foot with respect to the lid.

* * * * *